US011175053B2

(12) United States Patent
Komiya et al.

(10) Patent No.: US 11,175,053 B2
(45) Date of Patent: Nov. 16, 2021

(54) HEAT EXCHANGER, REFRIGERATION CYCLE DEVICE, AND AIR-CONDITIONING APPARATUS

(71) Applicant: Mitsubishi Electric Corporation, Tokyo (JP)

(72) Inventors: Yuta Komiya, Tokyo (JP); Daisuke Ito, Tokyo (JP); Akira Yatsuyanagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 80 days.

(21) Appl. No.: 16/499,444

(22) PCT Filed: Jun. 22, 2017

(86) PCT No.: PCT/JP2017/022942
§ 371 (c)(1),
(2) Date: Sep. 30, 2019

(87) PCT Pub. No.: WO2018/235215
PCT Pub. Date: Dec. 27, 2018

(65) Prior Publication Data

US 2020/0116365 A1 Apr. 16, 2020

(51) Int. Cl.
*F28F 1/30* (2006.01)
*F24F 1/0067* (2019.01)
(Continued)

(52) U.S. Cl.
CPC ..... *F24F 1/0067* (2019.02); *F28D 1/024* (2013.01); *F28F 1/20* (2013.01); *F28F 1/30* (2013.01); *F28F 2215/04* (2013.01)

(58) Field of Classification Search
CPC . F24F 1/0067; F28D 1/024; F28F 1/30; F28F 1/12; F28F 1/128; F28F 1/14; F28F 1/20; F28F 2215/04; F28F 2215/10
See application file for complete search history.

(56) References Cited

U.S. PATENT DOCUMENTS 3,190,352 A * 6/1965 Simpelaar ..... F28F 1/32 165/134.1
3,589,439 A * 6/1971 Huggins ..... F28D 1/0535 165/134.1
(Continued)

FOREIGN PATENT DOCUMENTS

CN 103314269 A 9/2013
EP 2 980 516 A1 2/2016
(Continued)

OTHER PUBLICATIONS

Extended European Search Report dated May 8, 2020 issued in corresponding European patent application No. 17915121.2.
(Continued)

*Primary Examiner* — Devon Russell
(74) *Attorney, Agent, or Firm* — Posz Law Group, PLC

(57) ABSTRACT

A heat exchanger to which a fan supplies air includes a plurality of flat tubes extending in a first direction, a corrugated fin connected to the flat tubes and extending in a second direction intersecting the first direction, and a plurality of plate fins connected to at least one of a windward end and a leeward end of the corrugated fin and extending in a third direction intersecting the second direction. This configuration achieves improvement in heat exchange performance.

12 Claims, 10 Drawing Sheets

(51) Int. Cl.
*F28D 1/02* (2006.01)
*F28F 1/20* (2006.01)

(56) References Cited

U.S. PATENT DOCUMENTS

| | | | | |
|---|---|---|---|---|
| 6,435,268 | B1 * | 8/2002 | Bhatti | F28D 1/0333 165/111 |
| 10,451,297 | B2 * | 10/2019 | Henderson | F24F 11/0008 |
| 2013/0299142 | A1 * | 11/2013 | Yoshioka | F25B 39/00 165/151 |
| 2013/0299153 | A1 | 11/2013 | Jindou et al. | |
| 2015/0034289 | A1 * | 2/2015 | Seo | B23P 15/26 165/173 |
| 2017/0030658 | A1 * | 2/2017 | Liu | F28D 1/053 |
| 2017/0030662 | A1 * | 2/2017 | Lee | F25B 39/00 |

FOREIGN PATENT DOCUMENTS

| | | | | |
|---|---|---|---|---|
| EP | 3 124 905 | A1 | | 2/2017 |
| JP | H05-060481 | A | | 3/1993 |
| JP | 2004-177082 | A | | 6/2004 |
| JP | 2005-178589 | A | | 7/2005 |
| JP | 2005-315486 | A | | 11/2005 |
| JP | 2008-096005 | A | | 4/2008 |
| JP | 2008096005 | A | * | 4/2008 |
| JP | 2015-105800 | A | | 6/2015 |

OTHER PUBLICATIONS

International Search Report of the International Searching Authority dated Sep. 12, 2017 for the corresponding international application No. PCT/JP2017/022942 (and English translation).
Office Action dated Mar. 16, 2021 issued in corresponding CN patent application No. 201780091782.6 (and English translation).

* cited by examiner

HEAT EXCHANGER, REFRIGERATION CYCLE DEVICE, AND AIR-CONDITIONING APPARATUS

CROSS REFERENCE TO RELATED APPLICATION

This application is a U.S. national stage application of International Application No. PCT/JP2017/022942, filed on Jun. 22, 2017, the contents of which are incorporated herein by reference.

TECHNICAL FIELD

The present invention relates to a heat exchanger, a refrigeration cycle device, and an air-conditioning apparatus.

BACKGROUND

A typical parallel flow heat exchanger includes a plurality of vertically extending flat tubes aligned parallel to each other and a plurality of corrugated fins each having a corrugated or curved surface extending vertically such that at least one corrugated fin is interposed between the adjacent flat tubes (refer to Patent Literature 1, for example).

CITATION LIST

Patent Literature

Patent Literature 1: Japanese Unexamined Patent Application Publication No. 5-60481

To improve the heat exchange performance of the above-described typical heat exchanger, the corrugated fins arranged between the flat tubes can be extended upwind or downwind of the heat exchanger to increase the area of each fin. In such a configuration, however, an increase in area of the fin is limited in view of the dimensions of the heat exchanger or the strength of the fin. The heat exchange performance of the heat exchanger may be unable to be sufficiently improved.

SUMMARY

The present invention has been made to solve the above-described problem and aims at providing a heat exchanger that exhibits improved heat exchange performance. Furthermore, the present invention aims at providing a refrigeration cycle device including the heat exchanger and an air-conditioning apparatus including the heat exchanger.

An embodiment of the present invention provides a heat exchanger that is supplied with air from a fan. The heat exchanger according to the embodiment of the present invention includes a plurality of heat transfer tubes extending in a first direction, a first fin connected to the plurality of heat transfer tubes and extending in a second direction intersecting the first direction, and a plurality of second fins connected to at least one of a windward end and a leeward end of the first fin and extending in a third direction intersecting the second direction.

In the heat exchanger according to the embodiment of the present invention, the plurality of second fins are connected to the end of the first fin such that the second fins extend in a direction intersecting the first fin. This arrangement increases the area of heat transfer, leading to improved heat exchange performance.

DETAILED DESCRIPTION

Figure 1:
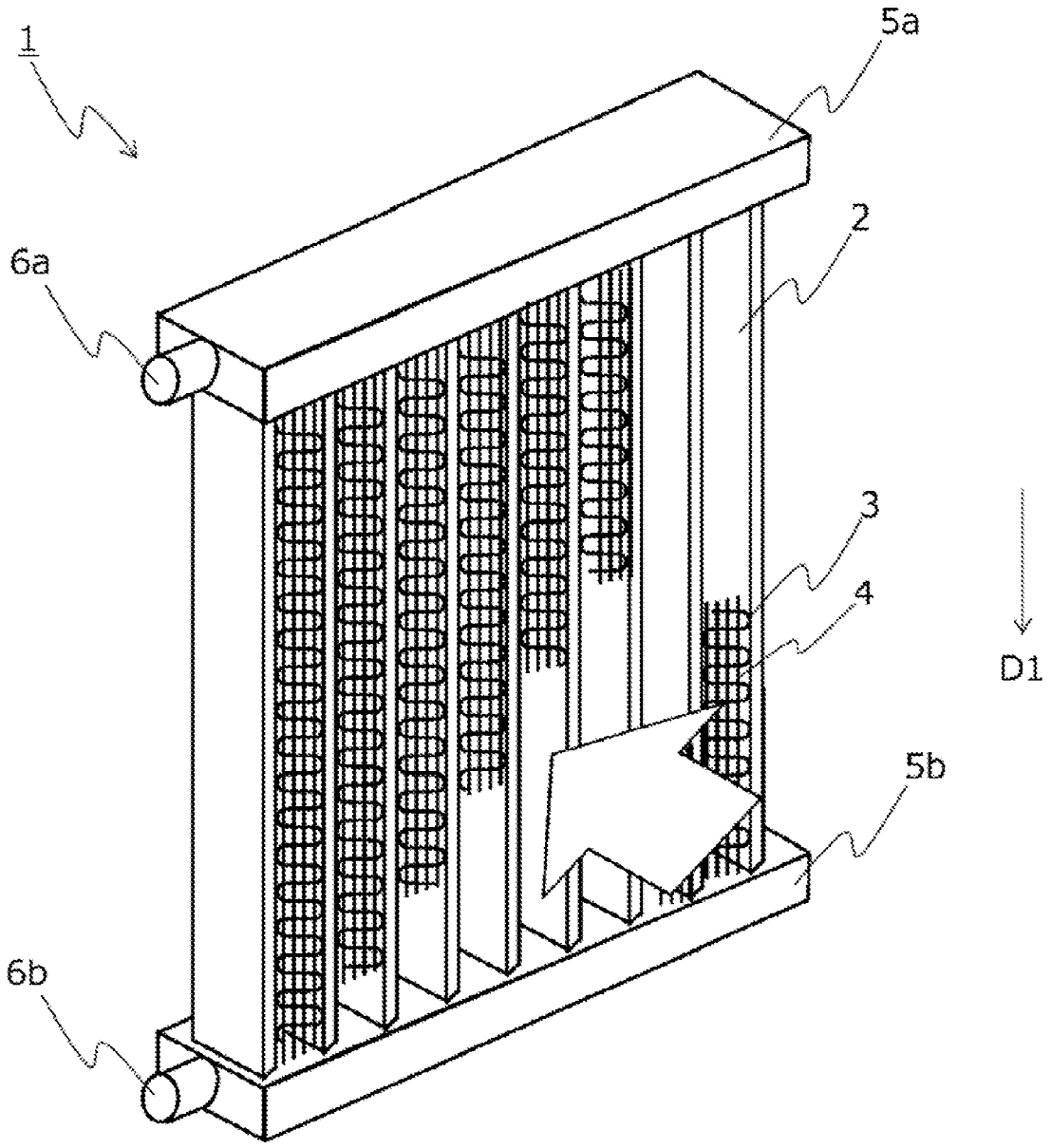
FIG. 1 is a perspective view of an example of a heat exchanger according to Embodiment 1 of the present invention.

Embodiments of the present invention will be described below with reference to the drawings. Note that the same components or equivalents in the following drawings are designated by the same reference signs and redundant description thereof is avoided. In the drawings, outlined arrows represent an air flow direction. Furthermore, note that the relationship between the sizes of components illustrated in the following drawings including FIG. 1 may differ from that of actual ones. Moreover, note that the forms of the components described herein are intended to be illustrative only and the forms of the components are not intended to be limited to those described herein.

Embodiment 1

A schematic configuration of a heat exchanger according to Embodiment 1 of the present invention will be described with reference to FIG. 1.

A heat exchanger 1 includes a plurality of flat tubes 2 extending in a first direction D1, a plurality of corrugated fins 3, each of which is disposed between the flat tubes 2 (or between adjacent flat tubes 2), a plurality of plate fins 4 connected to the corrugated fins 3, a header 5*a*, and a header 5*b*. The headers 5*a* and 5*b* are connected to opposite ends of the flat tubes 2 in the first direction D1. The flat tubes 2 correspond to heat transfer tubes in the present invention. Each corrugated fin 3 corresponds to a first fin in the present invention. Furthermore, the plate fins 4 correspond to second fins in the present invention.

The plurality of the flat tubes 2 are spaced apart from each other in a direction orthogonal to the first direction D1. The plurality of the flat tubes 2 are arranged parallel to each other. A fan supplies air to the heat exchanger 1. The air passes between the flat tubes 2 and comes into contact with the flat tubes 2, the corrugated fins 3, and the plate fins 4.

The header 5*a* is connected to first ends of the flat tubes 2 in the first direction D1 and has a refrigerant port 6*a*. The header 5*b* is connected to second ends of the flat tubes 2 in the first direction D1 and has a refrigerant port 6*b*. In the heat exchanger 1, refrigerant, which is a working fluid, that has entered the header 5*a* through the refrigerant port 6*a*, passes through passages 7, which will be described later, arranged in the flat tubes 2, enters the header 5*b*, and flows out of the header through the refrigerant port 6*b*. In other words, the heat exchanger 1 is a parallel flow heat exchanger. The direction in which the refrigerant flows is not limited to the above-described one. The refrigerant may flow in a direction opposite to the above-described direction.

Figure 2:
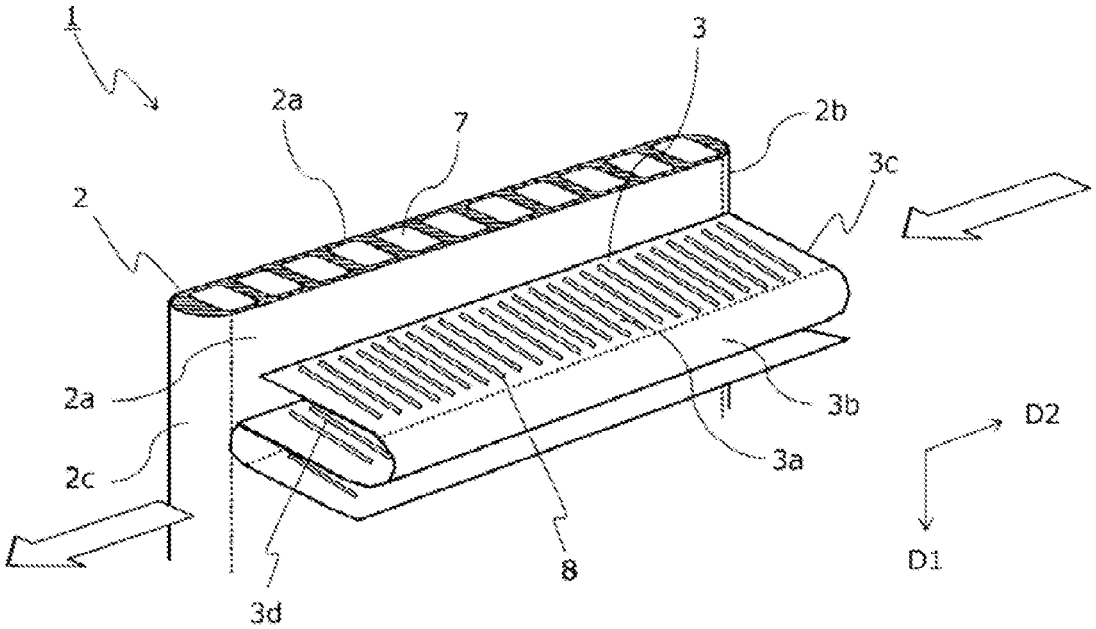
FIG. 2 is a perspective view of essential parts of the heat exchanger according to Embodiment 1 of the present invention.

The structures of the flat tubes 2, the corrugated fins 3, and the plate fins 4 in the heat exchanger 1 will now be described in detail with reference to FIGS. 2 to 4. For the sake of convenience, the plate fins 4 are not illustrated in FIG. 2.

Each of the flat tubes 2 has therein a plurality of the passages 7 through which the refrigerant flows in the first direction D1. The plurality of the passages 7 are arranged in the air flow direction. Each flat tube 2 has an outer wall including a pair of flat portions 2*a* each defining a flat surface, a windward end 2*b* as a curved face, and a leeward end 2*c* as a curved face. The cross-sectional shape of the flat tube 2 is flat and has a length in the air flow direction. The flat tube 2 is made of, for example, aluminum alloy. The number of passages 7 is not limited to plural and may be one.

The corrugated fins 3 are plate-like parts. Each corrugated fin 3 is formed by bending the plate-like part so as to allow flat portions 3*a* and curved portions 3*b* to be alternately arranged. The flat portions 3*a* are arranged at regular intervals and are substantially parallel to each other. Each flat portion 3*a* has a louver 8 formed by cutting parts of the flat portion 3*a* and raising the cut parts. The corrugated fin 3 is made of, for example, aluminum alloy.

Each corrugated fin 3 is connected to the flat tubes 2 extending in the first direction D1. Specifically, the curved portions 3*b* of the corrugated fin 3 are connected to the flat portions 2*a* of the outer walls of the flat tubes 2 by brazing. In this arrangement, the flat portions 3*a* are parallel to a second direction D2 intersecting the first direction D1. In other words, the flat portions 3*a* extend in the second direction D2 intersecting the first direction D1. Although FIG. 2 illustrates the heat exchanger 1 in which the first direction D1 is orthogonal to the second direction D2, the relationship between the first and second directions is not limited to the above-described one. It is only required that the first direction D1 is not parallel to the second direction D2. In addition, the way of joining the flat tubes 2 to the corrugated fins 3 is not limited to brazing. Welding may be used to join the flat tubes 2 to the corrugated fins 3.

Figure 3:
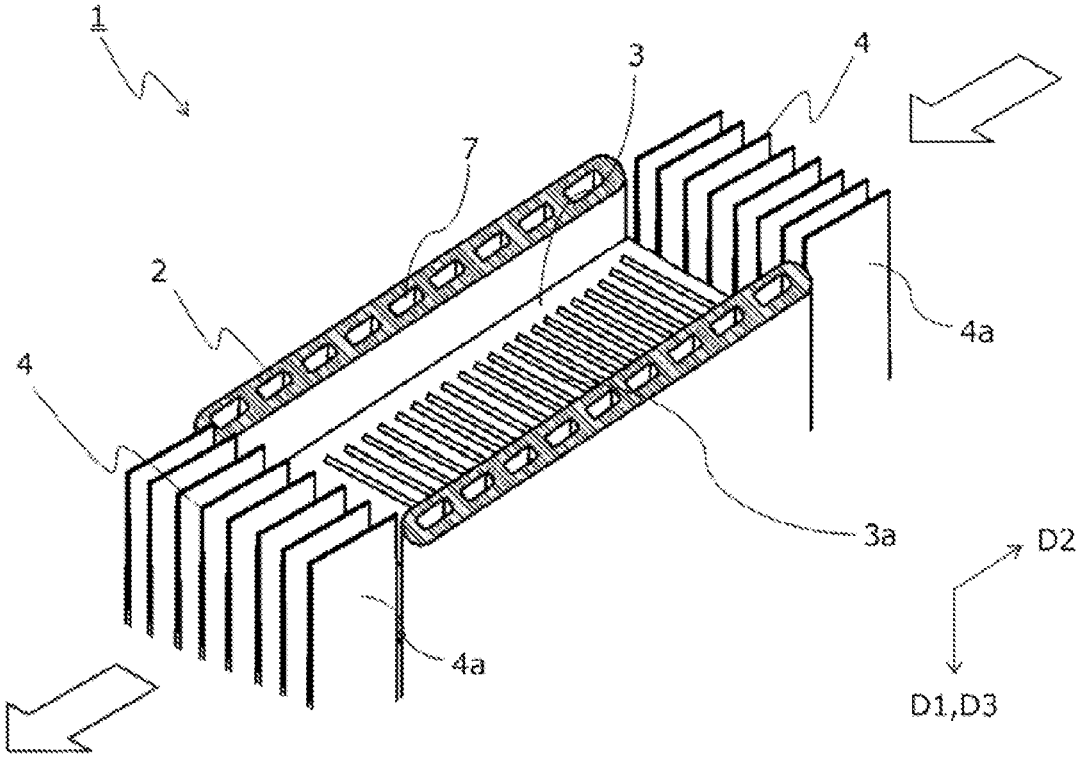
FIG. 3 is a perspective view of essential parts of the heat exchanger according to Embodiment 1 of the present invention.

As illustrated in FIG. 3, the plate fins 4 are arranged upwind and downwind of the corrugated fins 3 in the air flow direction. Each of the plate fins 4 is a plate-like part having a flat portion 4*a* defining a flat surface. The plate fins 4 are spaced apart from each other in a direction in which the flat tubes 2 are arranged. The plate fins 4 are made of, for example, aluminum alloy.

The flat portions 4*a* of the plate fins 4 are arranged in a direction intersecting a direction in which the flat portions 3*a* of the corrugated fins 3 are arranged. Specifically, the flat portions 4*a* of the plate fins 4 are surfaces parallel to a third direction D3 intersecting the second direction D2. In other words, the flat portions 4*a* extend in the third direction D3 intersecting the second direction D2. Although FIG. 3 illustrates the heat exchanger 1 in which the first direction D1 is identical with the third direction D3, the relationship between the directions is not limited to the above-described one. It is only required that the third direction D3 is not parallel to the second direction D2.

Figure 4:
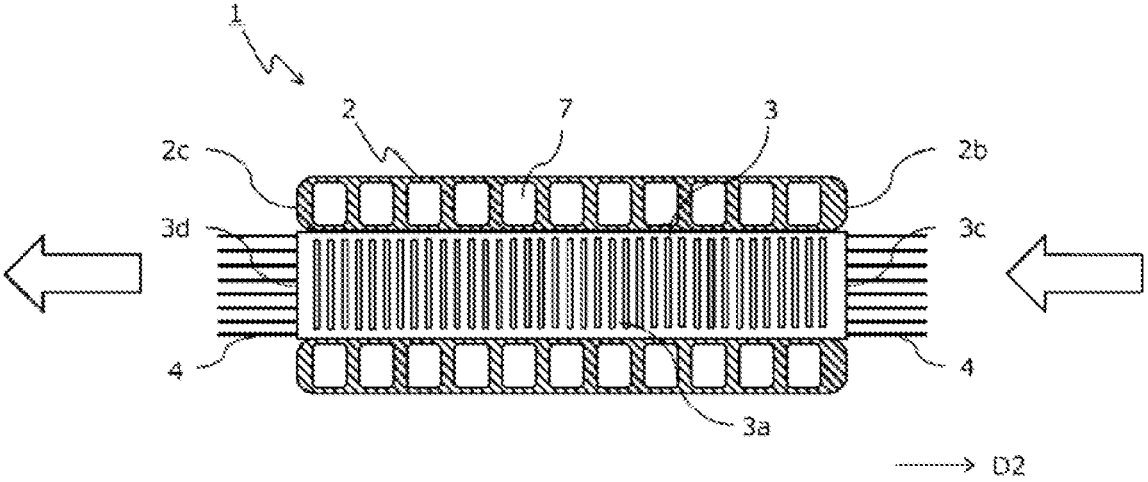
FIG. 4 is a sectional view of essential parts of the heat exchanger according to Embodiment 1 of the present invention.

As illustrated in FIG. 4, the plate fins 4 arranged upwind of the corrugated fins 3 are connected to windward ends 3*c* of the flat portions 3*a* of the corrugated fins 3 by brazing. Furthermore, the plate fins 4 arranged downwind of the corrugated fins 3 are connected to leeward ends 3*d* of the flat portions 3*a* of the corrugated fins 3 by brazing. The way of joining the corrugated fins 3 to the plate fins 4 is not limited to brazing. Welding may be used to join the corrugated fins 3 to the plate fins 4. In addition, the plate fins 4 arranged upwind of the corrugated fins 3 may be connected to windward ends 3*c* of the curved portions 3*b* of the corrugated fins 3. The plate fins 4 arranged downwind of the corrugated fins 3 may be connected to leeward ends 3*d* of the curved portions 3*b* of the corrugated fins 3.

Figure 5:
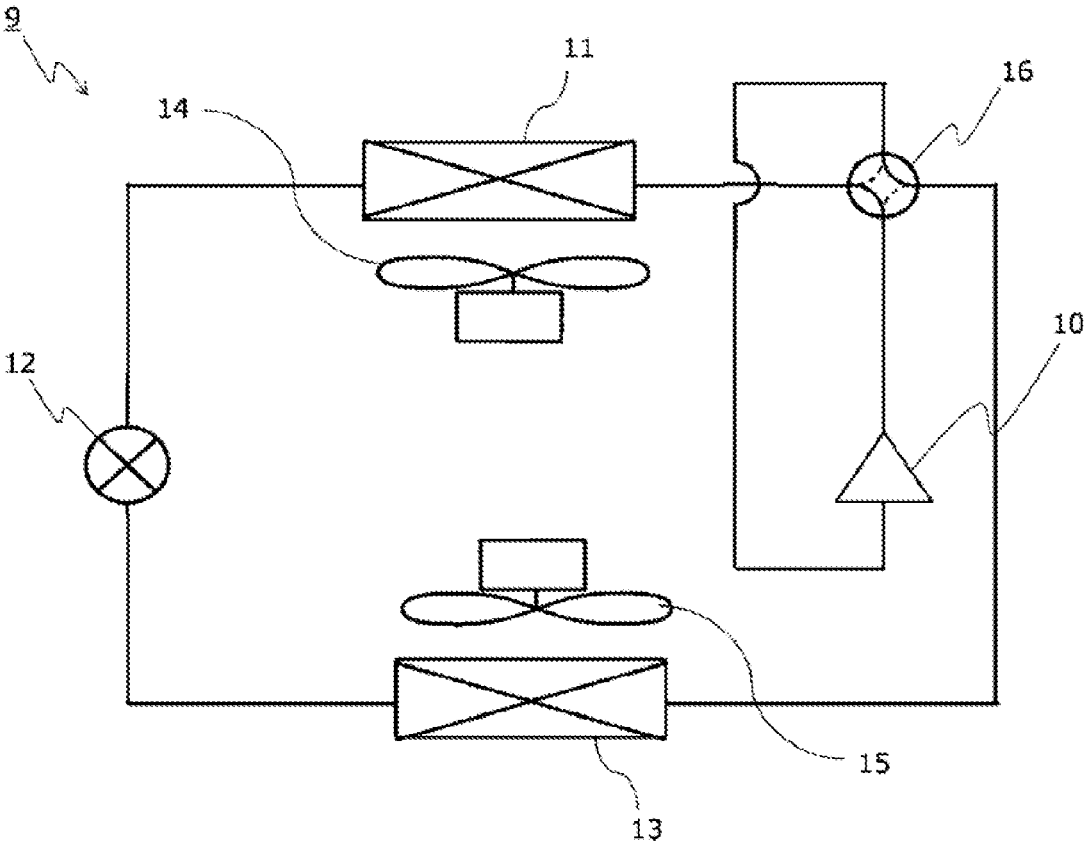
FIG. 5 is a refrigerant circuit diagram of a refrigeration cycle device including the heat exchanger according to Embodiment 1 of the present invention.

A refrigeration cycle device including the heat exchanger 1 will now be described with reference to FIG. 5.

A refrigeration cycle device 9 includes a compressor 10 configured to compress the refrigerant, a condenser 11 configured to condense the refrigerant, an expansion valve 12 configured to expand the refrigerant, an evaporator 13 to evaporate the refrigerant, a fan 14 disposed in proximity to the condenser 11, a fan 15 disposed in proximity to the evaporator 13, and a four-way valve 16 configured to switch between the refrigerant flow directions. The air-sending device 14 corresponds to a first air-sending device in the present invention. The air-sending device 15 corresponds to a second air-sending device in the present invention. The expansion valve 12 corresponds to an expander in the present invention.

When the four-way valve 16 switches the refrigerant flow directions, the condenser 11 functions as the evaporator 13, whereas the evaporator 13 functions as the condenser 11. The heat exchanger 1 is used as at least one of the condenser 11 and the evaporator 13. The heat exchanger 1 may be used in a refrigeration cycle device including no four-way valve 16. The refrigeration cycle device 9 is included in, for example, an air-conditioning apparatus or a refrigeration apparatus.

Heat exchange in the heat exchanger 1 will now be described. Air supplied to the heat exchanger 1 from the air-sending device 14 or the air-sending device 15 passes between the flat tubes 2 and comes into contact with the flat tubes 2, the corrugated fins 3, and the plate fins 4. Since the flat tubes 2 are connected to the corrugated fins 3 and the corrugated fins 3 are connected to the plate fins 4, heat of the refrigerant is transferred to the plate fins 4 through the flat tubes 2 and the corrugated fins 3. In other words, the surfaces of the flat tubes 2, the corrugated fins 3, and the plate fins 4 serve as heat transfer surfaces. These heat transfer surfaces transfer heat with the air passing through the heat exchanger 1.

As described above, each corrugated fin 3 is connected to the plate fins 4. This arrangement provides a greater area of heat transfer than an arrangement including only the corrugated fins 3, leading to improved heat exchange performance of the heat exchanger 1. In addition, the flat portions 4*a* of the plate fins 4 are arranged in the direction intersecting the direction in which the flat portions 3*a* of the corrugated fin 3 are arranged. This arrangement enables the plate fins 4 to be arranged in a direction along the width of the corrugated fin 3, or in the direction in which the flat tubes 2 are arranged. This results in an increase in heat transfer area, leading to improved heat exchange performance of the heat exchanger 1.

Drainage of condensate formed on the heat exchanger 1 will now be described. In the following description, it is assumed that the evaporator 13 is the heat exchanger 1 including the flat tubes 2 extending vertically or in a vertical direction (the first direction D1), the flat portions 3*a* of the corrugated fins 3 extending horizontally or in a horizontal direction (the second direction D2), and the flat portions 4*a* of the plate fins 4 extending in the vertical direction (the third direction D3).

In a case where the heat exchanger 1 is used as the evaporator 13, moisture in the air passing through the heat exchanger 1 may form droplets of water on the surfaces of the flat tubes 2, the corrugated fins 3, and the plate fins 4. Part of condensate formed on the flat portions 3*a* of the corrugated fins 3 flows from the windward ends 3*c* of the corrugated fins 3 to the plate fins 4 located upwind of the corrugated fins 3, flows vertically downward on the flat portions 4*a* of the plate fins 4, and is then discharged.

Furthermore, part of the condensate formed on the flat portions 3*a* of the corrugated fins 3 flows from the leeward ends 3*d* of the corrugated fins 3 to the plate fins 4 located downwind of the corrugated fins 3, flows vertically downward on the flat portions 4*a* of the plate fins 4, and is then discharged.

Since the flat portions 3*a* of the corrugated fins 3 have the louvers 8, part of the condensate formed on the flat portions 3*a* of the corrugated fins 3 passes through openings of the louvers 8, flows vertically downward, and is then discharged. Condensate formed on the plate fins 4 flows vertically downward on the flat portions 4*a* and is then discharged.

As described above, the plate fins 4 having the flat portions 4*a*, which extend vertically, are connected to the corrugated fins 3 having the flat portions 3*a*, which extend horizontally. This arrangement allows the condensate formed on the flat portions 3*a* of the corrugated fins 3 to flow on the flat portions 4*a* of the plate fins 4 and be discharged, leading to improved drainage performance of the heat exchanger 1. In addition, the louvers 8 of the flat portions 3*a* further improve the drainage performance.

A large amount of condensate is formed on a windward side where the difference in temperature between air and a heat transfer surface is large. The plate fins 4 arranged on the windward side enable a large amount of condensate formed on the windward side to be discharged. Furthermore, part of the condensate formed on the corrugated fins 3 experiences a downwind force applied by the air passing through the heat exchanger 1 and thus flows toward a leeward side. The plate fins 4 arranged on the leeward side enable the condensate flowing toward the leeward side to be discharged.

For the above-described evaporator 13, the heat exchanger 1 including the plate fins 4 having the flat portions 4*a* extending vertically has been described. The direction in which the flat portions 4*a* extend is not limited to the vertical direction. The flat portions 4*a* may extend in a direction at an angle to the horizontal direction. In such an arrangement in which the flat portions 4*a* extend in the direction at an angle to the horizontal direction, the force of gravity acts on the condensate formed on the plate fins 4, thus causing the condensate to flow on the flat portions 4*a* toward lower part of the heat exchanger 1. This leads to improved drainage performance.

Figure 6:
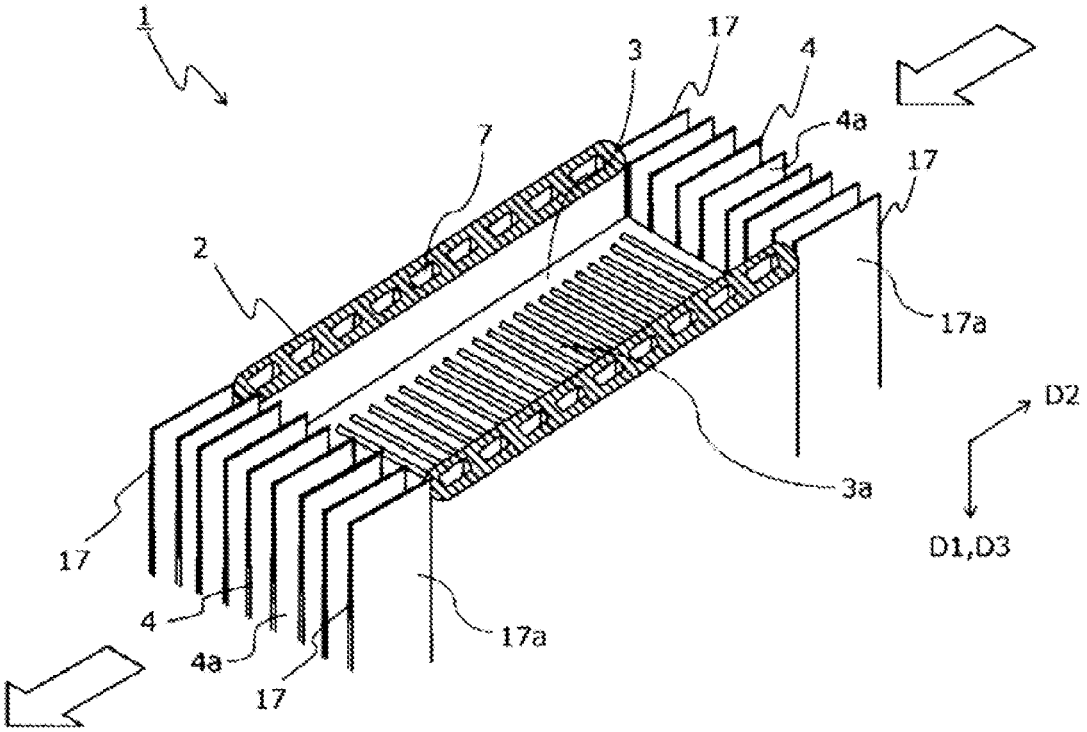
FIG. 6 is a perspective view of essential parts of a modification of the heat exchanger according to Embodiment 1 of the present invention.
Figure 7:
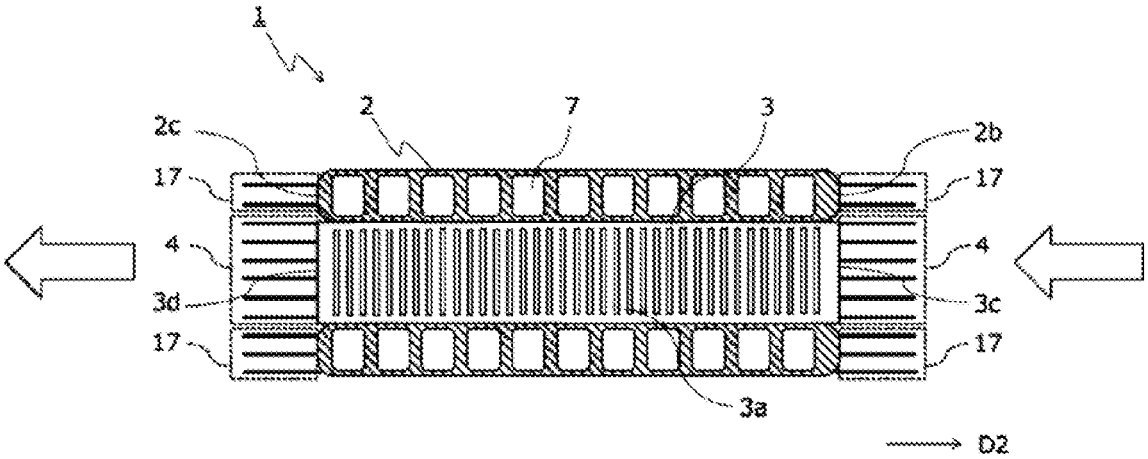
FIG. 7 is a sectional view of essential parts of the modification of the heat exchanger according to Embodiment 1 of the present invention.

The above-described heat exchanger 1 may further include a plate fin 17 connected to at least one of the windward end 2*b* and the leeward end 2*c* of at least one of the flat tubes 2, as illustrated in FIGS. 6 and 7. The number of plate fins 17 may be one or more. The plate fin 17 corresponds to a third fin in the present invention.

Like the plate fin 4, the plate fin 17 is a plate-like part having a flat portion 17*a*. The flat portion 17*a* of the plate fin 17 is a surface parallel to the third direction D3. Specifically, the flat portion 17*a* is spaced apart from and parallel to the flat portion 4*a* of the plate fin 4. The plate fin 17 is made of, for example, aluminum alloy. The above-described configuration including the plate fin 17 connected to the flat tube 2 provides a greater heat transfer area than the configuration including only the plate fins 4, leading to improved heat exchange performance of the heat exchanger 1.

Embodiment 2

Figure 8:
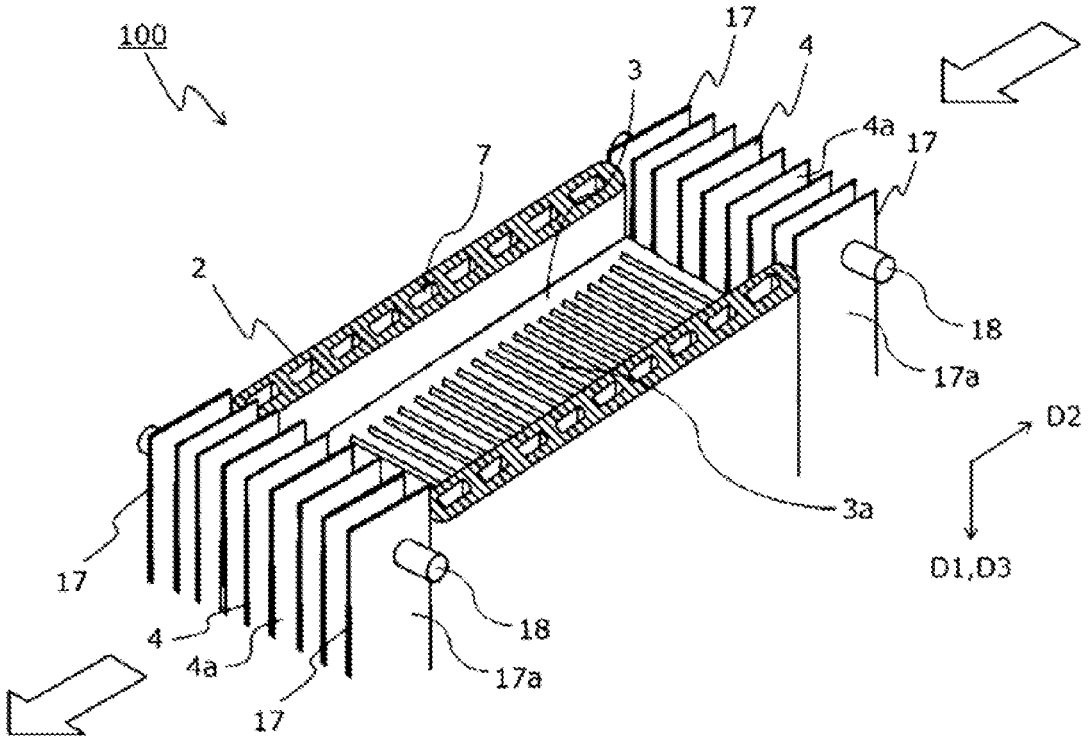
FIG. 8 is a perspective view of essential parts of a heat exchanger according to Embodiment 2 of the present invention.

A heat exchanger 100 according to Embodiment 2 of the present invention will be described with reference to FIG. 8. Unlike the heat exchanger according to Embodiment 1, the heat exchanger 100 includes connection parts 18 connected to the plate fins 4 and the plate fins 17.

Each connection part 18 is connected to each of the plate fins 4 and the plate fins 17 and thus holds them together. Specifically, the connection part 18 extends through the flat portions 4*a* of the plate fins 4 and the flat portions 17*a* of the plate fins 17. The connection part 18 is solid and cylindrical.

The heat exchanger 100 with the above-described configuration offers the same advantages as those in Embodiment 1. In addition, the connection parts 18 each hold the plate fins 4 and the plate fins 17 integrally. This arrangement facilitates connection of the plate fins to the flat tubes 2 and the corrugated fins 3, leading to improved manufacturability of the heat exchanger 100. Furthermore, this arrangement reduces the possibility that the distance between the plate fins 4 and 17 may differ from a set distance. In addition, this arrangement increases the strength of the plate fins 4 and 17, thus reducing the likelihood that the plate fins 4 and 17 may be buckled.

The shape of each connection part 18 is not limited to a solid cylinder. The connection part 18 may have any other shape, such as a solid prismatic shape. The connection part 18 does not have to extend through the plate fins 4 and 17. The connection part 18 may be connected to ends of the plate fins 4 and 17 and hold them together. Furthermore, the connection part 18 may connect only the plate fins 4 and hold them integrally.

Embodiment 3

A heat exchanger 200 according to Embodiment 3 of the present invention will be described with reference to FIGS.

9 and 10. Unlike the heat exchanger according to Embodiment 1, the heat exchanger 200 includes the flat tubes 2 longer than the flat portions 3*a* of the corrugated fins 3 in the air flow direction.

Figure 9:
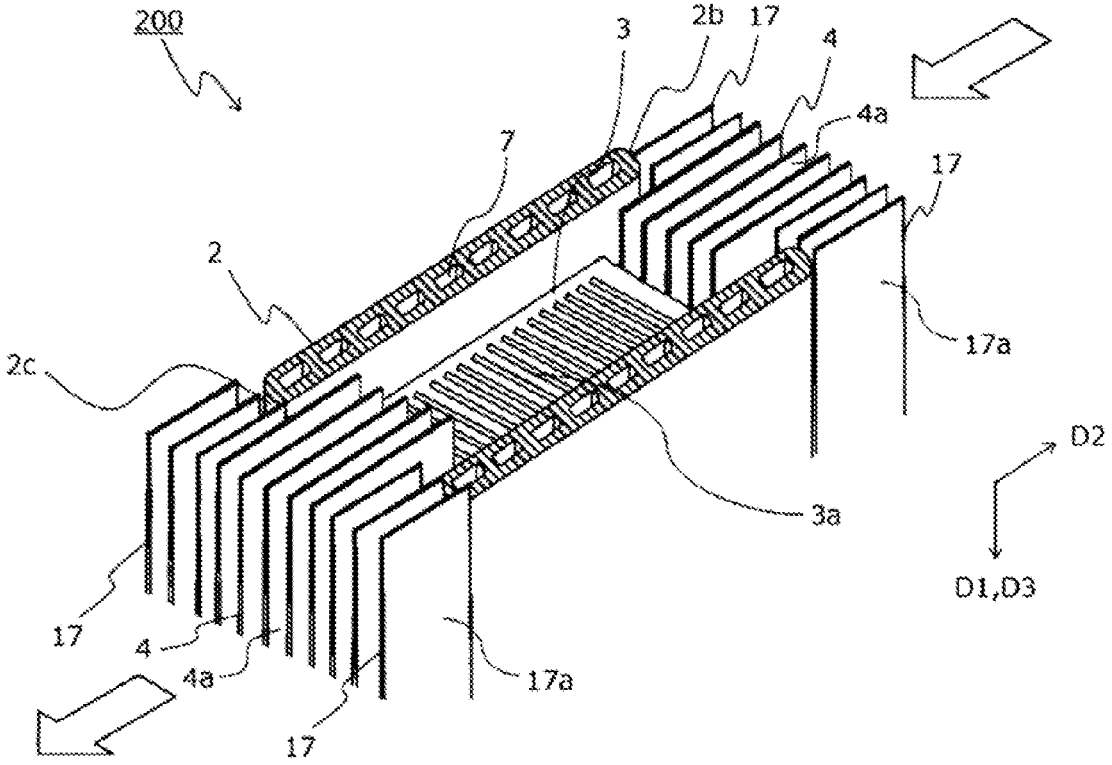
FIG. 9 is a perspective view of essential parts of a heat exchanger according to Embodiment 3 of the present invention.
Figure 10:
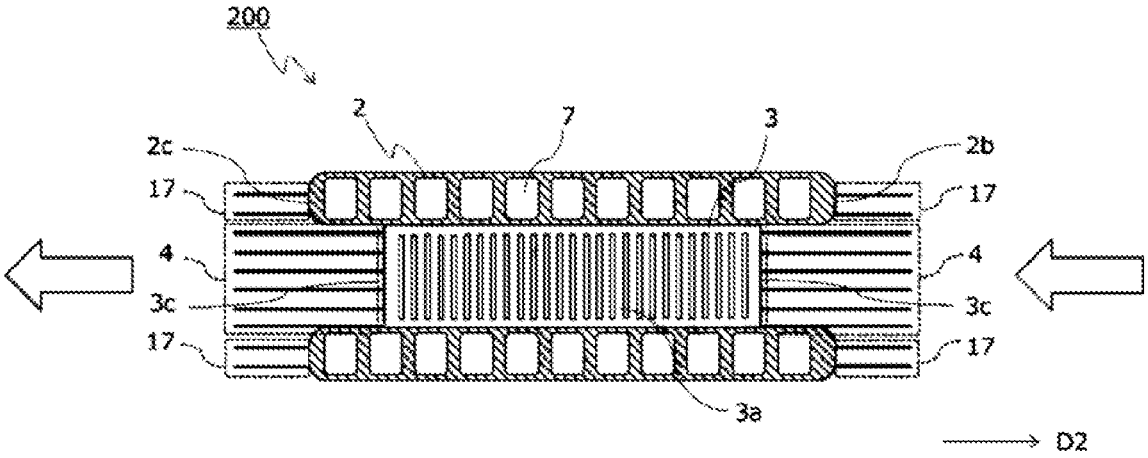
FIG. 10 is a sectional view of essential parts of the heat exchanger according to Embodiment 3 of the present invention.

As illustrated in FIGS. 9 and 10, the windward end 2*b* and the leeward end 2*c* of each flat tube 2 extend beyond the windward ends 3*c* and the leeward ends 3*d* of the flat portions 3*a* of each corrugated fin 3, respectively. Furthermore, the plate fins 4 attached are partly received in the spacing between the adjacent flat tubes 2. In other words, the plate fins 4 are partly arranged between the adjacent flat tubes 2.

The heat exchanger 200 with the above-described configuration offers the same advantages as those in Embodiment 1. Since the flat tubes 2 are longer than the flat portions of each corrugated fin 3 in the air flow direction, the plate fins 4 attached and connected to the corrugated fin 3 are partly received in the spacing between the adjacent flat tubes 2. This arrangement facilitates positioning of the plate fins 4, leading to improved manufacturability of the heat exchanger 200.

Embodiment 4

Figure 11:
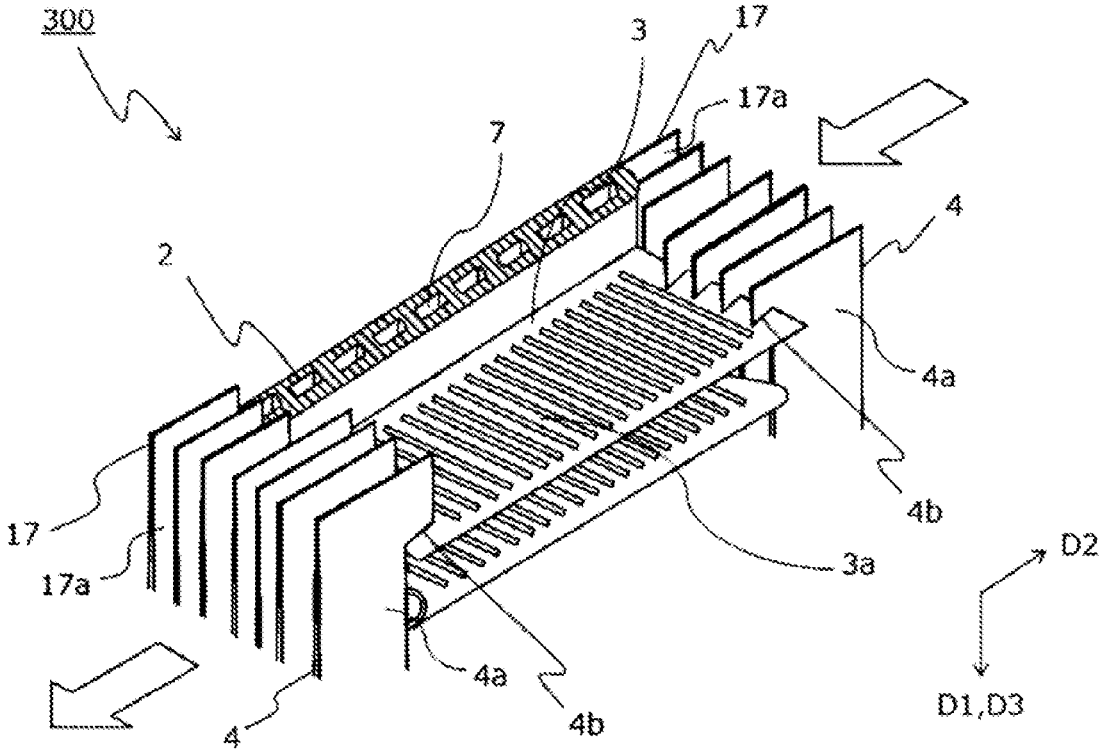
FIG. 11 is a perspective view of essential parts of a heat exchanger according to Embodiment 4 of the present invention.

A heat exchanger 300 according to Embodiment 4 of the present invention will be described with reference to FIG. 11. Unlike the heat exchanger according to Embodiment 1, the heat exchanger 300 includes the plate fins 4 having the flat portions 4*a* with notches 4*b*.

The flat portion 4*a* of each plate fin 4 has the notch 4*b* on a side adjacent to the corrugated fin 3. The notch 4*b* is L-shaped. The corrugated fin 3 is connected to the notch 4*b* of the plate fin 4. Specifically, the notch 4*b* is located on the flat portions 3*a* or the curved portions 3*b* of the corrugated fin 3 while the corrugated fin 3 is connected to the plate fin 4. In other words, the notch 4*b* is fitted on the flat portion 3*a*, serving as one end of the corrugated fin 3. The notch 4*b* corresponds to a first notch in the present invention.

The heat exchanger 300 with the above-described configuration offers the same advantages as those in Embodiment 1. The corrugated fins 3 are connected to the notches 4*b* of the plate fins 4. This arrangement results in an increase in area of contact between the corrugated fins 3 and the plate fins 4. This facilitates heat transfer from the corrugated fins 3 to the plate fins 4, leading to improved heat exchange performance of the heat exchanger 300.

Since the corrugated fins 3 are connected to the notches 4*b*, the plate fins 4 can be positioned relative to the corrugated fins 3 in the third direction D3. This facilitates fixing the plate fins 4 to the corrugated fins 3, leading to improved manufacturability of the heat exchanger 300.

Although the L-shaped notch 4*b* has been described as an example, the notch may be a U-shaped notch. The notch 4*b* may have any other shape.

Figure 12:
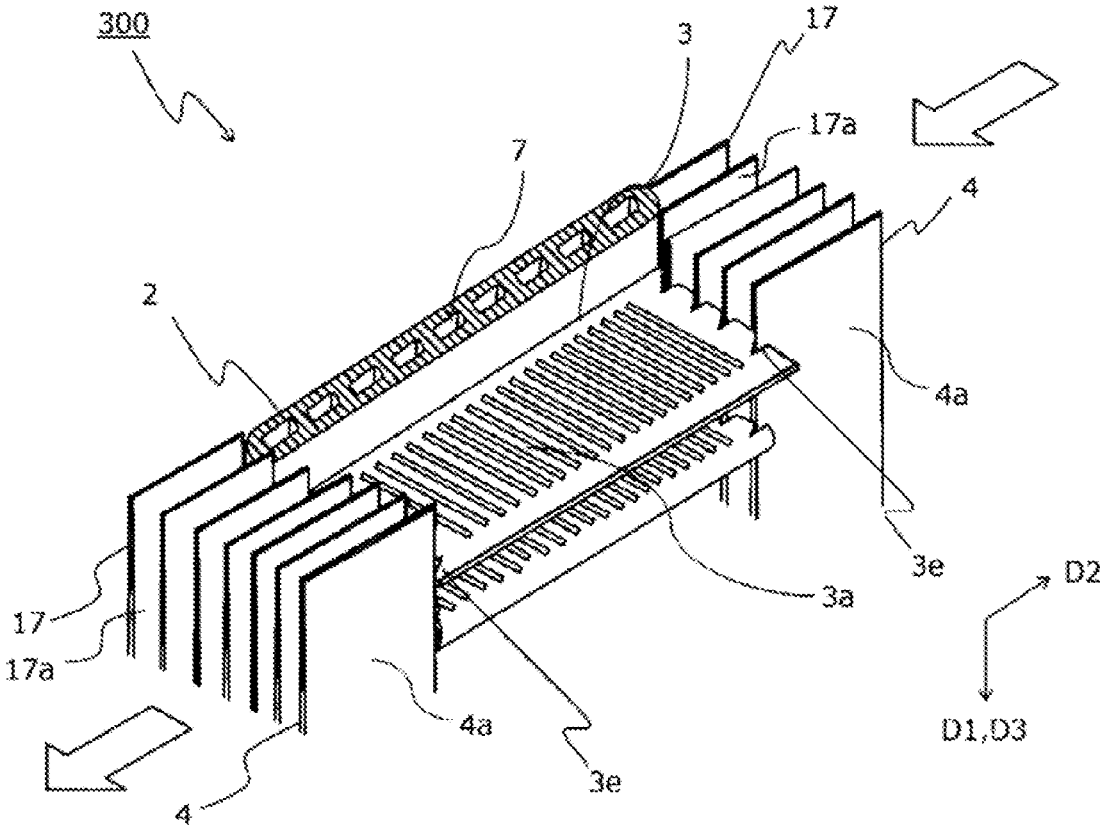
FIG. 12 is a perspective view of essential parts of a modification of the heat exchanger according to Embodiment 4 of the present invention.

As illustrated in FIG. 12, the flat portions 3*a* of each corrugated fin 3 may have notches 3*e* and the plate fins 4 may be connected to the notches 3*e* of the corrugated fin 3.

The flat portions 3*a* of the corrugated fin 3 have the notches 3*e* on opposite ends adjacent to the plate fins 4. The notches 3*e* are U-shaped. The plate fins 4 are connected to the notches 3*e* of the corrugated fin 3. Specifically, the plate fins 4 are received in the notches 3*e*. Each notch 3*e* corresponds to a second notch in the present invention. The notches 3*e* may be located on opposite ends of the curved portions 3*b* of the corrugated fin 3 adjacent to the plate fins 4.

The heat exchanger 300 with the above-described configuration offers the same advantages as those in Embodiment 1. The plate fins 4 are connected to the notches 3*e* of the corrugated fins 3. This arrangement results in an increase in area of contact between the corrugated fins 3 and the plate fins 4. This facilitates heat transfer from the corrugated fins 3 to the plate fins 4, leading to improved heat exchange performance of the heat exchanger 300.

Since the plate fins 4 are connected to the notches 3*e*, the plate fins 4 can be positioned relative to the corrugated fins 3 in the direction in which the flat tubes 2 are arranged. This facilitates fixing the plate fins 4 to the corrugated fins 3, leading to improved manufacturability of the heat exchanger of the heat exchanger 300.

The plate fins 4 may have the notches 4*b*, the corrugated fins 3 may have the notches 3*e*, and the plate fins 4 may be connected to the corrugated fins 3 by using the notches 4*b* and the notches 3*e*. This makes it easier to fix the plate fins 4 to the corrugated fins 3, thus further improving the manufacturability.

Embodiment 5

A heat exchanger 400 according to Embodiment 5 of the present invention will be described with reference to FIG. 13. Unlike the heat exchanger according to Embodiment 1, the heat exchanger 400 includes the corrugated fins 3 including the flat portions 3*a* arranged at an angle to the horizontal direction.

Figure 13:
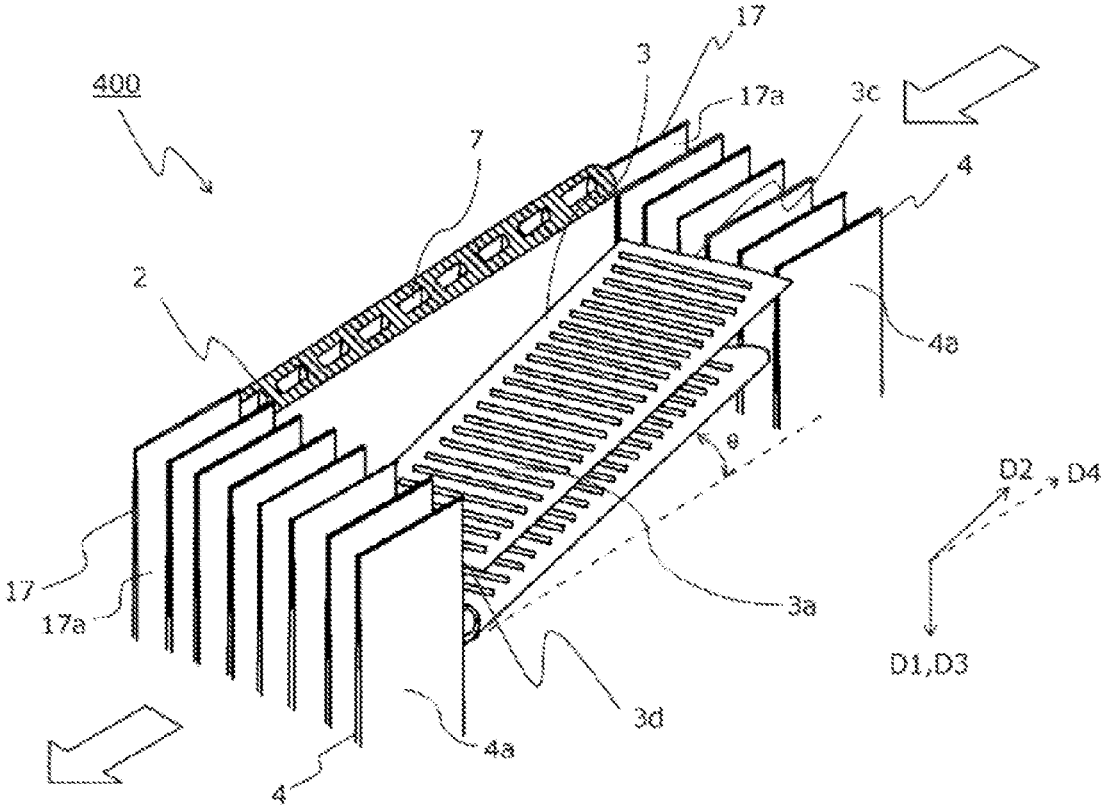
FIG. 13 is a perspective view of essential parts of a heat exchanger according to Embodiment 5 of the present invention.

As illustrated in FIG. 13, the second direction D2 in which the flat portions 3*a* of each corrugated fin 3 extend is at an angle θ to the horizontal direction, represented at D4. For example, the flat portions 3*a* are subjected to water-repellent treatment to make it easy for condensate to flow in a sloping direction in which the flat portions 3*a* slope downward. Surface treatment for the flat portions 3*a* is not limited to water-repellent treatment. The flat portions 3*a* may be subjected to hydrophilic treatment.

The heat exchanger 400 with the above-described configuration offers the same advantages as those in Embodiment 1. Since the flat portions 3*a* of each corrugated fin 3 are at an angle to, or slope relative to, the horizontal direction, condensate on the flat portions 3*a* flows in the sloping direction of the flat portions 3*a*. The condensate flows toward the connected plate fins 4, flows vertically downward on the flat portions 4*a* of the plate fins 4, and is then discharged. This leads to improved drainage performance of the heat exchanger 400.

Embodiment 6

Figure 14:
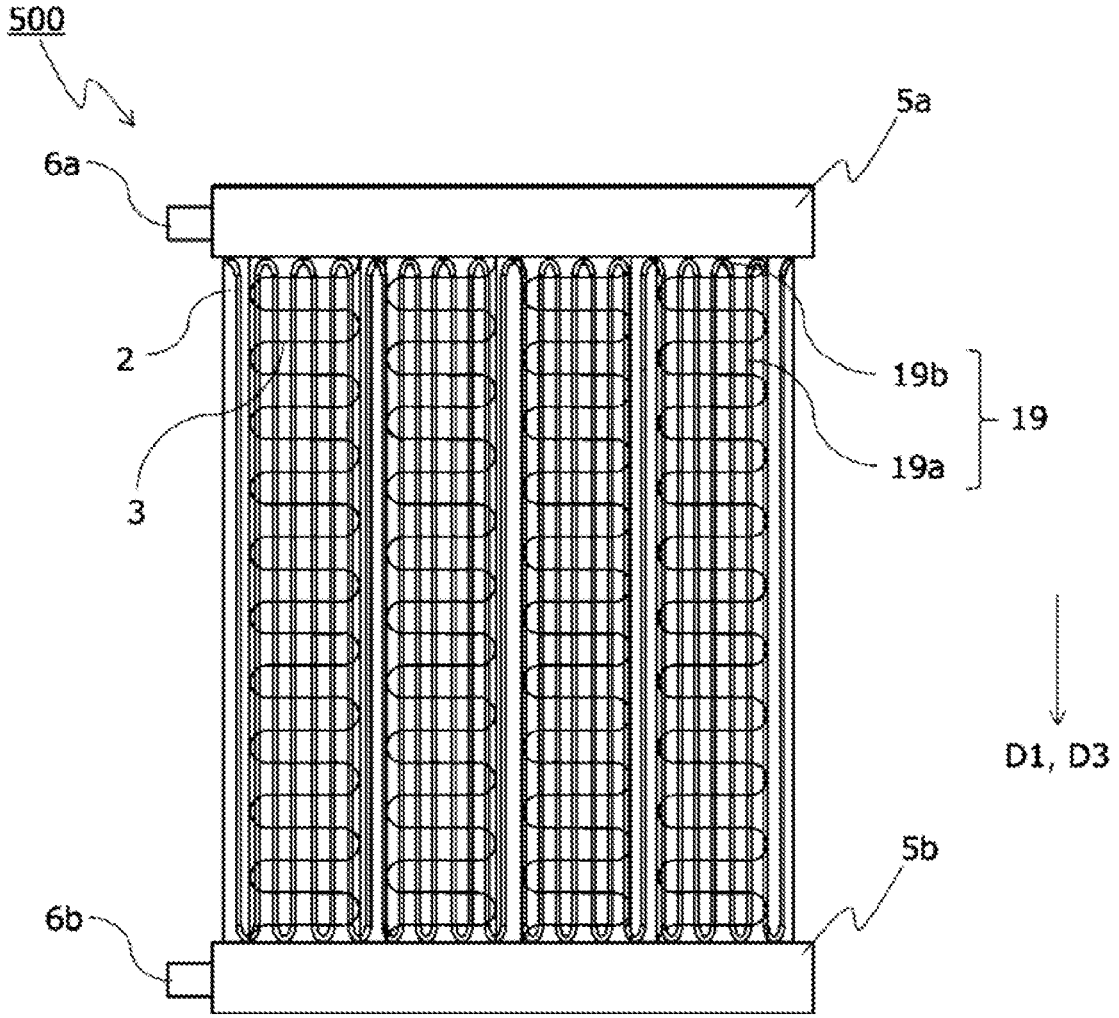
FIG. 14 is a front view of a heat exchanger according to Embodiment 6 of the present invention.

A heat exchanger 500 according to Embodiment 6 of the present invention will be described with reference to FIG. 14. Unlike the heat exchangers according to Embodiments 1 to 5, the heat exchanger 500 includes corrugated fins 19 instead of the plate fins 4.

The corrugated fins 19 are connected to the windward ends 3*c* and the leeward ends 3*d* of the flat portions 3*a* of the corrugated fins 3. Each of the corrugated fins 19 is a plate-like part. The corrugated fin 19 includes flat portions 19*a* and curved portions 19*b*, which are alternately arranged by bending the plate-like part. The flat portions 19*a* are arranged at regular intervals and are substantially parallel to each other. As illustrated in FIG. 14, parts of the corrugated fins 19 may be connected to the curved portions 3*b* of the corrugated fins 3.

Like the flat portions 4*a* of the plate fins 4 described in Embodiments 1 to 5, the flat portions 19*a* extend in the third direction D3 intersecting the second direction D2 in which the flat portions 3*a* of the corrugated fins 3 extend. Each of the curved portions 19*b* is connected to the header 5*a* or the header 5*b*. Each corrugated fin 19 is made of, for example, aluminum alloy. The corrugated fin 19 corresponds to the second fin in the present invention.

The heat exchanger 500 with the above-described configuration offers the same advantages as those in Embodiment 1. Since each of the curved portions 19*b* of the corrugated fins 19 is connected to the header 5*a* or the header 5*b*, heat of the refrigerant flowing through the header 5*a* or the header 5*b* is transferred to the corrugated fins 19. This leads to improved heat exchange performance of the heat exchanger 500. In addition, the plate fins 4 described in Embodiments 1 to 5 can be replaced by one corrugated fin 19. This leads to improved manufacturability of the heat exchanger 500.

The corrugated fins 19 may be used instead of the plate fins 4 and the plate fins 17. In other words, the corrugated fins 19 may be connected to the flat tubes 2 and the corrugated fins 3.

Specifically, the corrugated fin 19 disposed on the windward side may be connected to the windward ends 2*b* of the flat tubes 2 and the windward ends 3*c* of the corrugated fins 3. The corrugated fin 19 disposed on the leeward side may be connected to the leeward ends 2*c* of the flat tubes and the leeward ends 3*d* of the corrugated fins 3. This arrangement enables replacement of the plate fins 4 and the plate fins 17 arranged on the windward side or the leeward side with one corrugated fin 19, thus further improving the manufacturability of the heat exchanger.

Embodiment 7

An air-conditioning apparatus 20 according to Embodiment 7 of the present invention will be described with reference to FIGS. 15 and 16. The air-conditioning apparatus 20 is, for example, a separate-type air-conditioning apparatus intended for home use. The air-conditioning apparatus 20 includes the refrigeration cycle device 9 of FIG. 5.

Figure 15:
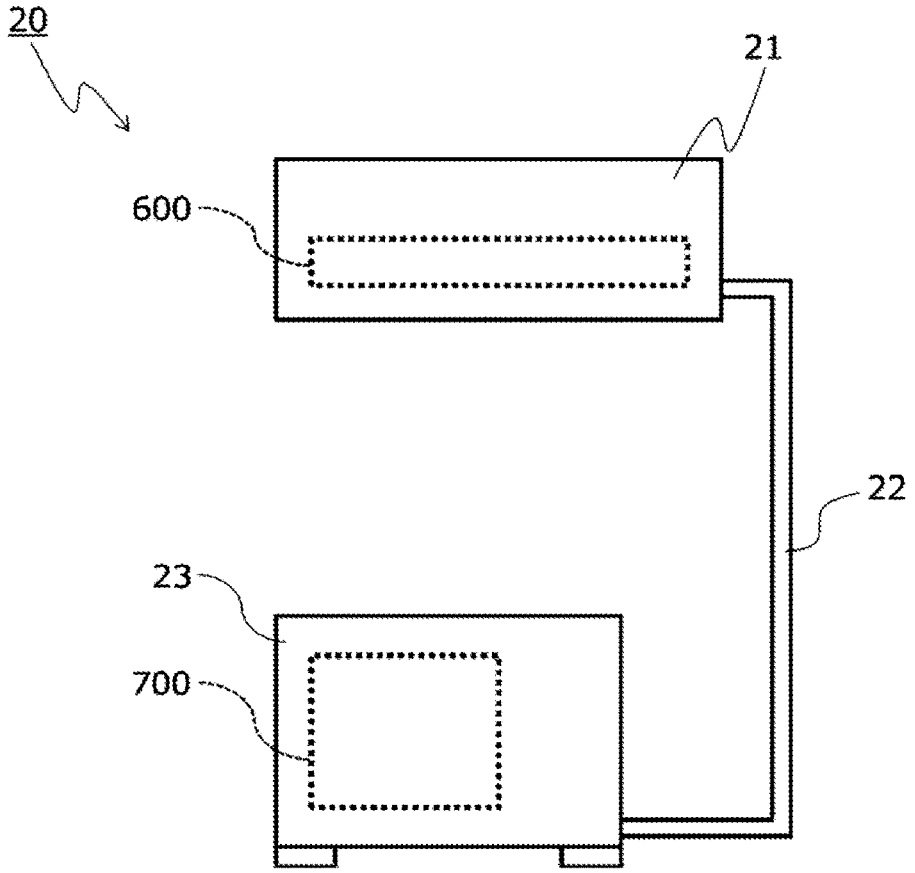
FIG. 15 is a front view of an example of an air-conditioning apparatus according to Embodiment 7 of the present invention.
Figure 16:
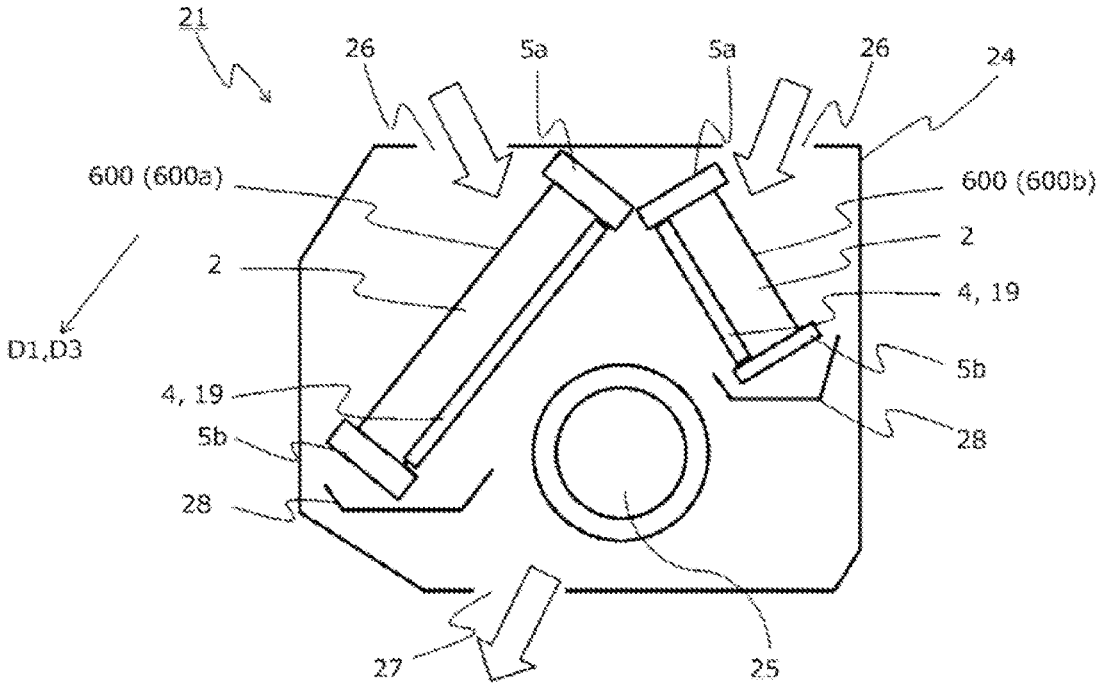
FIG. 16 is a cross-sectional view of an example of an indoor unit included in the air-conditioning apparatus according to Embodiment 7 of the present invention.

As illustrated in FIG. 15, the air-conditioning apparatus 20 includes an indoor unit 21, refrigerant pipes 22, and an outdoor unit 23 connected to the indoor unit 21 by the refrigerant pipes 22. At least one of the indoor unit 21 and the outdoor unit 23 of the air-conditioning apparatus 20 includes any of the heat exchangers described in Embodiments 1 to 6 (including modifications of Embodiments). Specifically, any of the heat exchangers described in Embodiments 1 to 6 (including the modifications thereof) is used as at least one of a heat exchanger 600 included in the indoor unit 21 and a heat exchanger 700 included in the outdoor unit 23.

Since at least one of the indoor unit 21 and the outdoor unit 23 includes any of the heat exchangers described in Embodiments 1 to 6 (including the modifications thereof), the air-conditioning apparatus 20 with the above-described configuration offers the same advantages as those in any of Embodiments 1 to 6.

An internal configuration of the indoor unit 21 will now be described. FIG. 16 is a cross-sectional view of the indoor unit 21 mounted on, for example, a wall of a room. The up-down direction in FIG. 16 corresponds to the direction of gravity (the vertical direction). The indoor unit 21 includes a casing 24 defining a shell, the heat exchanger 600 disposed in the casing, and a cross flow fan 25, serving as a fan. The casing 24 has an upper surface with an air inlet 26. The casing 24 has a lower surface with an air outlet 27. The casing 24 has therein an air path (not illustrated) extending from the air inlet 26 to the air outlet 27. The air taken into the indoor unit 21 through the air inlet 26 is subjected to heat exchange in the heat exchanger 600. The air subjected to heat exchange is blown into the room through the air outlet 27 by driving the cross flow fan 25. The indoor unit 21 further includes a drain pan 28 for receiving condensate formed during operation in which the heat exchanger 600 is used as an evaporator.

Any of the heat exchangers described in Embodiments 1 to 6 is used as the heat exchanger 600. The heat exchanger 600 includes a heat exchanger component 600*a* disposed adjacent to a front surface of the indoor unit 21 and a heat exchanger component 600*b* disposed adjacent to a rear surface thereof. The heat exchanger components 600*a* and 600*b* are inclined to the cross flow fan 25 relative to the vertical direction to cover upper part of the cross flow fan 25. Specifically, the flat tubes 2 extend in a direction (the first direction D1) at an angle to the vertical direction and the flat portions 4*a* of the plate fins 4 (or the flat portions 19*a* of the corrugated fin 19) extend in a direction (the third direction D3) at an angle to the vertical direction. In the heat exchanger components 600*a* and 600*b*, the plate fins 4 (or the corrugated fin 19) are connected only to the leeward ends 3*d* of the flat portions 3*a* of the corrugated fins 3. The flat portions 3*a* of the corrugated fins 3 extend in a direction intersecting the first direction D1.

Assuming that condensate is formed on the heat exchanger 600, the condensate experiences a downwind force applied by the air passing through the heat exchanger 600 and the force of gravity. Thus, the condensate on the flat tubes 2 and the corrugated fins 3 flows toward the plate fins 4 (or the corrugated fin 19) connected to the leeward ends 3*d* of the flat portions 3*a* of the corrugated fins 3, flows on the flat portions 4*a* of the plate fins 4 (or the flat portions 19*a* of the corrugated fin 19) in a direction in which the flat portions 4*a* are inclined downward, and is discharged to the drain pan 28.

The air-conditioning apparatus 20 with the above-described configuration offers the same advantages as those in Embodiment 1. Since a plurality of the plate fins 4 (or the corrugated fin 19) are arranged downwind of the corrugated fins 3, condensate formed on the heat exchanger 600 flows on the flat portions 4*a* of the plate fins 4 (or the flat portions 19*a* of the corrugated fin 19) and is then discharged to the drain pan 28. This reduces the possibility that condensate formed on the heat exchanger 600 may drip into the cross flow fan 25 disposed downwind of the heat exchanger 600 and be released into the room through the air outlet 27.

A plurality of the plate fins 4 (or the corrugated fin 19) may be connected to the windward ends 3*c* of the corrugated fins 3.

In the above-described exemplary configurations in Embodiments 1 to 6, a plurality of the plate fins 4 (or the corrugated fins 19) are connected to the windward ends 3*c* and the leeward ends 3*d* of the flat portions 3*a* of the corrugated fins 3. The plate fins 4 (or the corrugated fin 19) may be connected to either the windward ends 3*c* or the leeward ends 3*d*.

Although the heat exchangers including the plate fins 17 connected to the flat tubes 2 have been described in Embodiments 1 to 7 described above, inclusion of the plate fins 17 in the heat exchanger may be optional.

In the above-described exemplary configurations in Embodiments 1 to 7, each corrugated fin 3 is disposed between the adjacent flat tubes 2. A plate fin having a flat portion 3*a* may be disposed instead of the corrugated fin 3. Any type of fin may be disposed between the adjacent flat tubes 2.

In the above-described exemplary configurations in Embodiments 1 to 7, the corrugated fins 3 have the louvers 8. Arrangement of the louvers 8 in the corrugated fins 3 may be optional.

In the above-described exemplary configurations in Embodiments 1 to 7, the flat tubes 2, the corrugated fins 3, and a plurality of the plate fins 4 are made of aluminum alloy. The material for these components is not limited to the above-described one. These components may be made of copper or copper alloy.

The connection parts 18 described in Embodiment 2 may be used in the other embodiments. Furthermore, the configuration described in Embodiment 3, in which the flat tubes 2 are longer than the flat portions 3*a* of the corrugated fins 3, may be used in the other embodiments. Moreover, the notches 3*e* and the notches 4*b* described in Embodiment 4 may be used in the other embodiments. Additionally, the configuration described in Embodiment 5, in which the flat portions 3*a* of the corrugated fins 3 are inclined at an angle to the horizontal direction, may be used in the other embodiments. In addition, the corrugated fins 19 described in Embodiment 6 may be used in the other embodiments.

The features of the above-described embodiments and those of the modifications can be appropriately combined.

The invention claimed is:

1. A heat exchanger that is supplied with air from a fan, the heat exchanger comprising:

a plurality of heat transfer tubes extending in a first direction;

a first fin connected to the plurality of heat transfer tubes, and having a flat portion disposed between two adjacent heat transfer tubes among the plurality of the heat transfer tubes, the first fin extending in a flow direction of the air intersecting the first direction; and a plurality of second fins connected to at least one of a windward end and a leeward end of the flat portion of the first fin, the plurality of second fins extending in the first direction and being parallel each other, wherein the flat portion and the plurality of second fins are joined so that in each of the plurality of second fins, an end facing the one of the windward end and the leeward end of the flat portion and the one of the windward end and the leeward end of the flat portion intersect and contact each other.

2. The heat exchanger of claim 1, further comprising:

a connection part connected to each of the plurality of second fins.

3. The heat exchanger of claim 1, wherein a length of each of the plurality of heat transfer tubes is longer than a length of the first fin in the flow direction of the air.

4. The heat exchanger of claim 1, wherein the plurality of second fins each have a first notch on a side adjacent to the first fin, and wherein the first fin is connected to the first notches.

5. The heat exchanger of claim 1, wherein the first fin has a plurality of second notches on the end adjacent to the plurality of second fins, and wherein each of the plurality of second fins is connected to a corresponding one of the plurality of second notches.

6. The heat exchanger of claim 1, further comprising:

headers connected to opposite ends of the plurality of heat transfer tubes in the first direction, wherein at least parts of the plurality of second fins are connected to the headers.

7. The heat exchanger of claim 1, further comprising:

a third fin connected to at least one of a windward end and a leeward end of at least one of the plurality of heat transfer tubes, the third fin extending in the first direction.

8. A refrigeration cycle device comprising:

a compressor configured to compress refrigerant;

a condenser configured to condense the refrigerant;

an expander configured to expand the refrigerant;

an evaporator configured to evaporate the refrigerant;

a first fan configured to supply air to the condenser; and a second fan configured to supply air to the evaporator, wherein at least one of the condenser and the evaporator is the heat exchanger of claim 1.

9. The refrigeration cycle device of claim 8, wherein the heat exchanger is disposed such that the first direction intersects a horizontal direction.

10. The refrigeration cycle device of claim 8, wherein the heat exchanger is disposed such that the flow direction of the air intersects a horizontal direction.

11. An air-conditioning apparatus comprising:

an indoor unit; and the refrigeration cycle device of claim 8, wherein the heat exchanger is included in the indoor unit.

12. The heat exchanger of claim 1, wherein the first fin is a corrugated fin.

* * * * *